US009922582B1

(12) United States Patent
Rock

(10) Patent No.: US 9,922,582 B1
(45) Date of Patent: Mar. 20, 2018

(54) WALL MOUNTING APPARATUS

(76) Inventor: Robert Edward Rock, Dania Beach, FL (US)

( * ) Notice: Subject to any disclaimer, the term of this patent is extended or adjusted under 35 U.S.C. 154(b) by 1443 days.

(21) Appl. No.: 12/586,492

(22) Filed: Sep. 23, 2009

Related U.S. Application Data

(60) Provisional application No. 61/099,878, filed on Sep. 24, 2008.

(51) Int. Cl.
*G09F 3/10* (2006.01)
*A47F 5/08* (2006.01)

(52) U.S. Cl.
CPC . *G09F 3/10* (2013.01); *A47F 5/08* (2013.01)

(58) Field of Classification Search
USPC ..... 211/87.01, 75, 85.17, 90.02, 106.01, 211/94.01; 248/689, 690, 691, 692, 693, 248/305, 306, 339, 304, 490, 475.1, 489, 248/488
See application file for complete search history.

(56) References Cited

U.S. PATENT DOCUMENTS 1,964,335 A 6/1934 Wessman
3,028,259 A * 4/1962 Webber ..... 428/353
3,160,280 A * 12/1964 Burch ..... 211/89.01
3,669,035 A * 6/1972 Grossman ..... 108/152
3,797,143 A * 3/1974 Miller ..... 40/658
4,334,372 A * 6/1982 Colmar ..... 40/650
5,105,958 A * 4/1992 Patton ..... 215/388
5,394,632 A * 3/1995 Gebka et al. ..... 40/661.03
5,419,066 A * 5/1995 Harnois et al. ..... 40/661.03
5,507,464 A 4/1996 Hamerski
5,947,322 A * 9/1999 Ho ..... 220/477
6,001,471 A 12/1999 Bries
6,136,397 A 10/2000 Lühmann
6,641,892 B2 * 11/2003 Luhmann ..... 428/99
6,811,126 B2 * 11/2004 Johansson et al. ..... 248/205.3
7,178,770 B2 2/2007 Ryu
7,228,981 B2 * 6/2007 Chisholm ..... 215/382
7,270,309 B2 * 9/2007 Burns et al. ..... 248/317
7,802,766 B2 * 9/2010 Thompson ..... 248/220.1
7,954,651 B2 * 6/2011 Kao ..... 211/70.6
2003/0092875 A1 * 5/2003 Okamoto et al. ..... 528/272
2005/0098699 A1 * 5/2005 Schoenmaker et al. ..... 248/339
2010/0021669 A1 * 1/2010 Miyata et al. ..... 428/41.3

* cited by examiner

*Primary Examiner* — Alfred J Wujciak

(57) ABSTRACT

Apparatus for removably supporting an article such as a bottle, box, or hook on a vertical wall is provided by two parts. A first part is adhered to the wall. A second part is adhered to, or is a part of, the article. Each of the parts has a portion of a holding mechanism that cooperate to hold the article to the first part when the second part on the article slidingly engages the portion on the first part from above. The holding mechanism releases the article when it is lifted from the first part, and when it is pulled away from the first part.

4 Claims, 5 Drawing Sheets

WALL MOUNTING APPARATUS

This application claims the benefit of provisional application for patent Ser. No. 61/099,878 filed 24 Sep. 2008, incorporated herein by reference in its entirety.

FIELD OF THE INVENTION

This invention relates generally to article supports, and more particularly to article supports adapted to be rapidly adhered to, and repeatedly removed from, a vertical surface.

BACKGROUND OF THE INVENTION

It is useful to be able to support an item on a vertical wall for easy access in some situations. U.S. Pat. No. 5,507,464 issued Apr. 16, 1996 is exemplary of the prior art on surface mountable article supports in which a base member is adhesively attached to a surface to removably hold a support member such as a hook.

SUMMARY OF THE INVENTION

It is accordingly an object of the invention to provide a support for an article to enable the article to be mounted on a vertical surface such as a wall, and to enable the article to be readily removed and remounted as desired. The apparatus of the invention includes a base member that is adhesively attached to a vertical surface such as a wall and a support member that is attachable to the article to be mounted. Means are provided for removable attaching the support member with the article to the base member by sliding the support member onto the base member from above and to detach the support member from the base member by lifting it off, and/or by pulling it away.

These and other objects, features, and advantages of the invention will become more apparent from the detailed description of an exemplary embodiment thereof as illustrated in the accompanying drawings, in which like elements are designated by like reference characters in the various drawing figures.

DETAILED DESCRIPTION OF PREFERRED EMBODIMENTS

Figure 1:
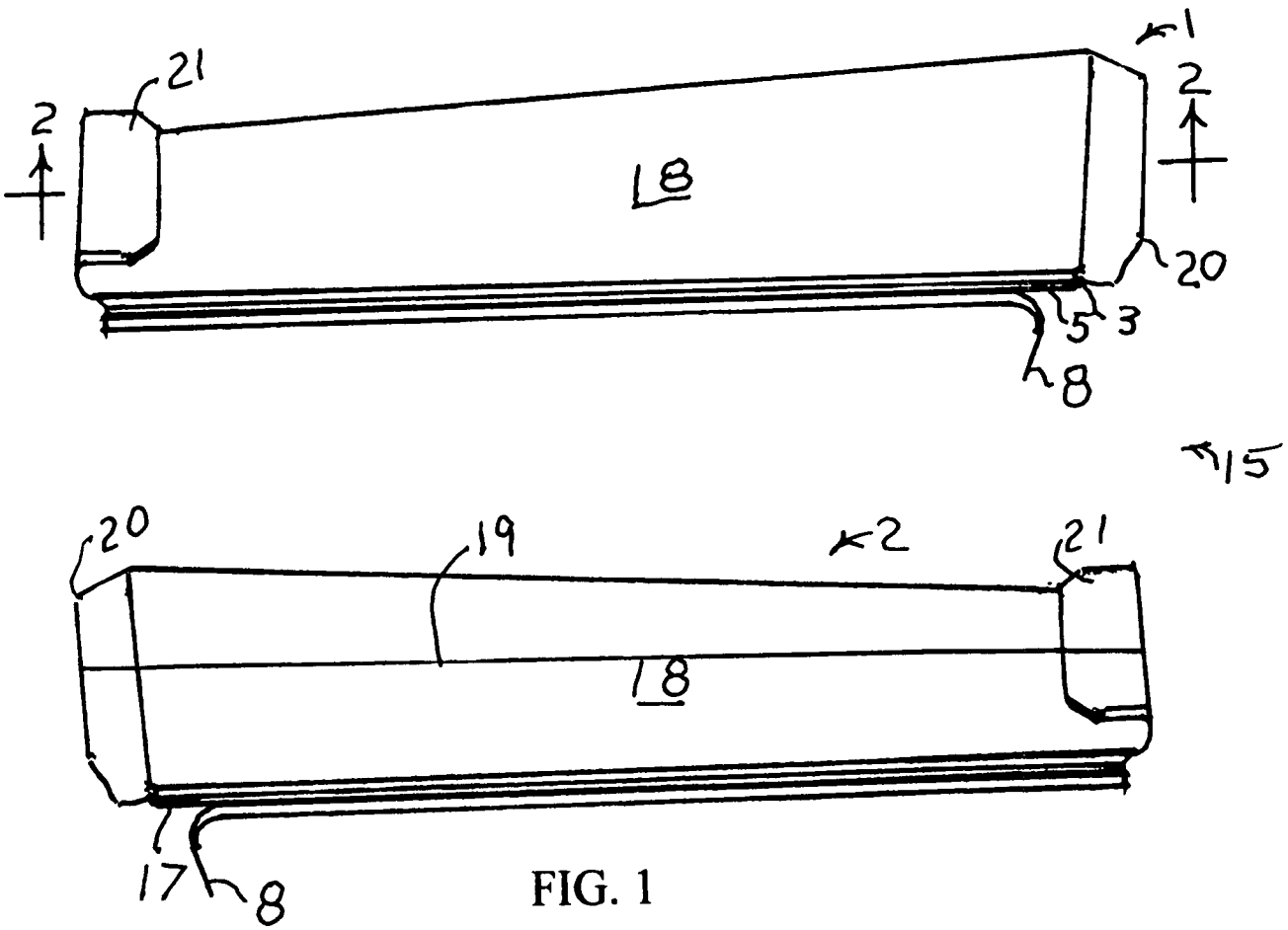
FIG. 1 is a plan view of an article support of the invention in two parts.
Figure 2:
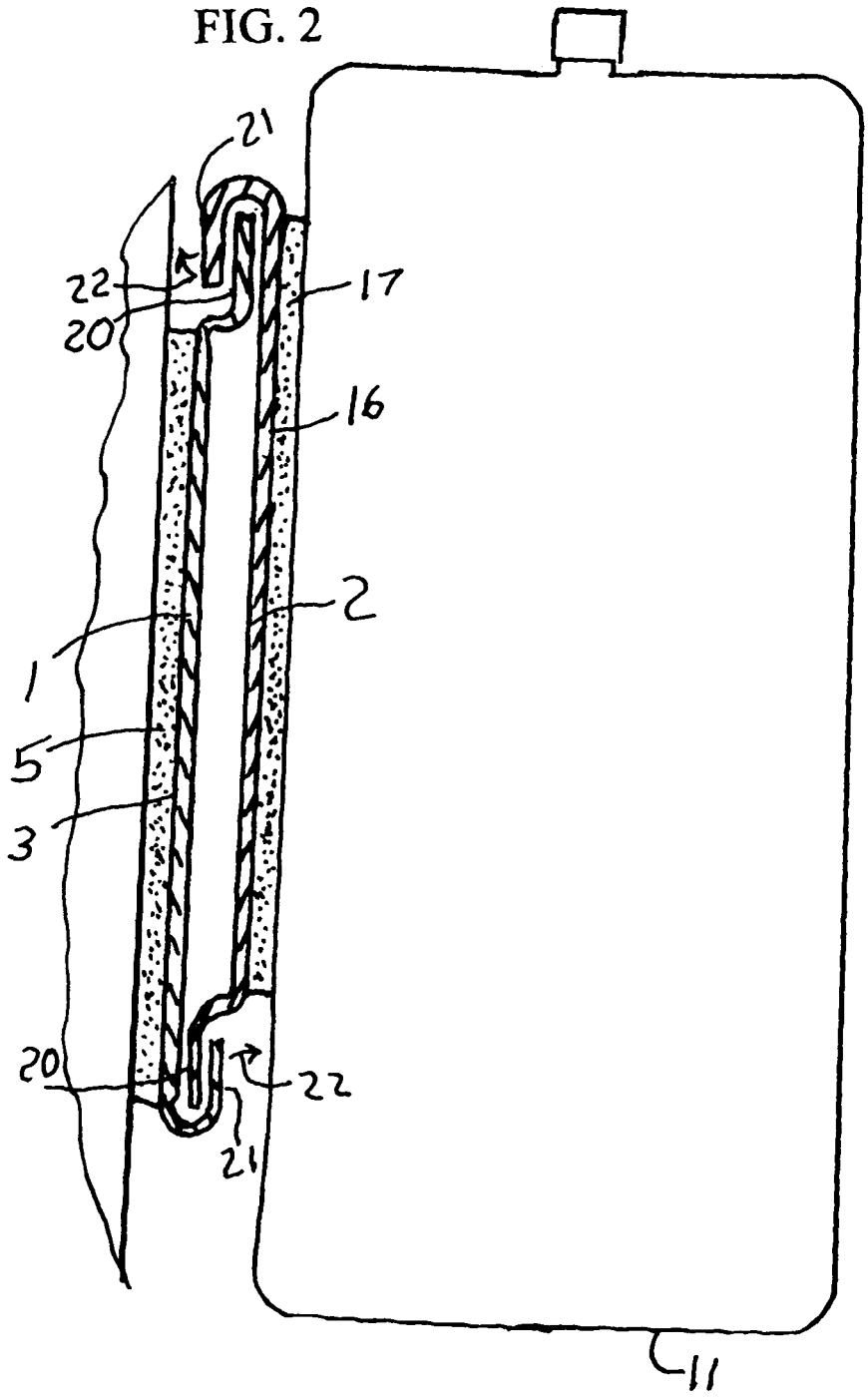
FIG. 2 is a sectional view through line 2-2 of FIG. 1 of the support in use.

Referring now first to the drawing FIGS. 1 and 2, an article support 15 of the invention is adapted to be removably mounted on a planar vertical substrate such as, but not limited to, a wall 7 by a pressure sensitive adhesive 5. The article support comprises two parts shown separate in FIG. 1, and joined together in use with an article 11 in FIG. 2. The first part is a base member 1 having a first face 3, at least a portion of which is planar, to which is affixed a pressure sensitive adhesive 5. A release member 8 protects the adhesive until it is peeled off for use when it is applied to the vertical substrate 7. When the release member is removed, the base member is transparent. This feature enhances the appearance of the substrate when the article is removed. The second part of the support 15 is support member 2. Support member 2 comprises a body 18 with an article engaging face 16 having adhesive 17 for affixing to an article 11 such as a bottle, box, hook, and the like. The adhesive may be protected before use by a release member 8. The support member 2 may be provided with a division 19 that partially or completely cuts through the device to enable better adhesion to a less than planar surface on the container 11. The two parts 1 and 2 may be interchangeable in some embodiments, if desired. The bodies 18 of both part 1 and part 2 includes attaching means for releasably holding the support member 2 against the base member 1. These are flexible elements that extend outwardly from each body. The flexible elements interact with each other to hold the support member to the base member. The attaching means includes a tongue 20 that extends outwardly from the body at one end, and a lip 21 that is folded over the body at the other end to receive the tongue of the other part. When base member 1 is affixed to the wall, the article 11 with support member 2, is held onto the base member by slidingly engaging the base member from above so that the lip 21 of 2 fits onto the tongue 20 of member 1, and the lip of member 1 fits onto the tongue 20 of member 2. The support member and any article attached to it is removed from the base by lifting it up, or by pulling it straight out from the base. The lips 21 are flexible enough that they bend outwardly enough as shown by arrows 22 to free the support member well before the force of pulling exceeds the peel strength of the adhesive.

Figure 3:
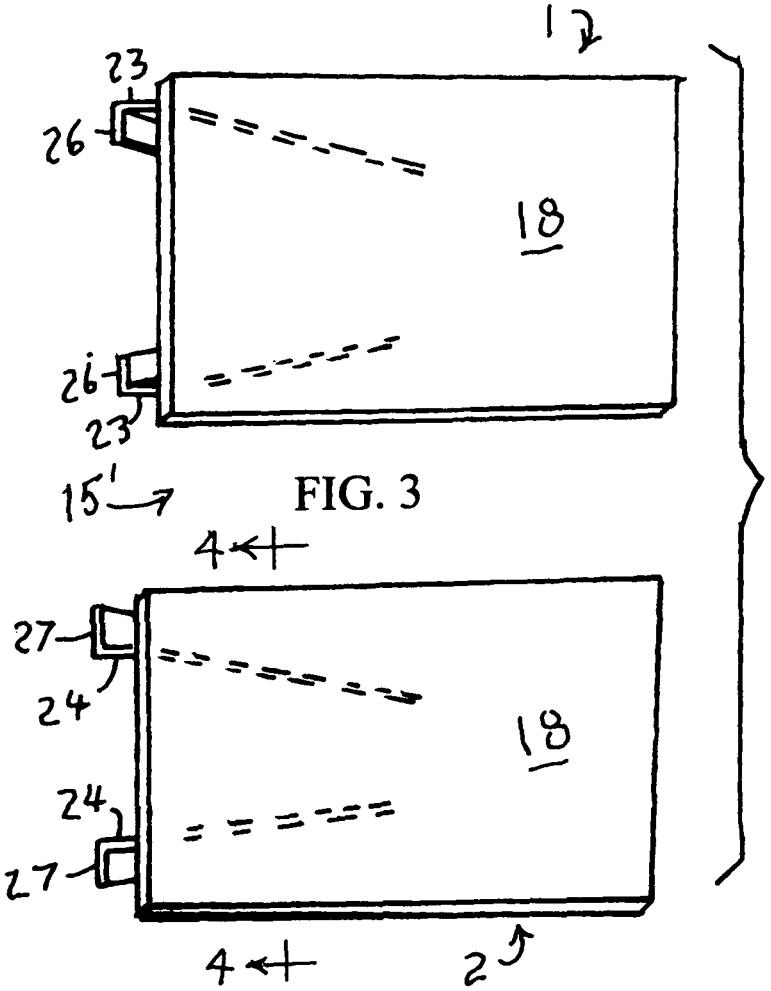
FIG. 3 is a plan view of another embodiment of the invention in two parts.
Figure 4:
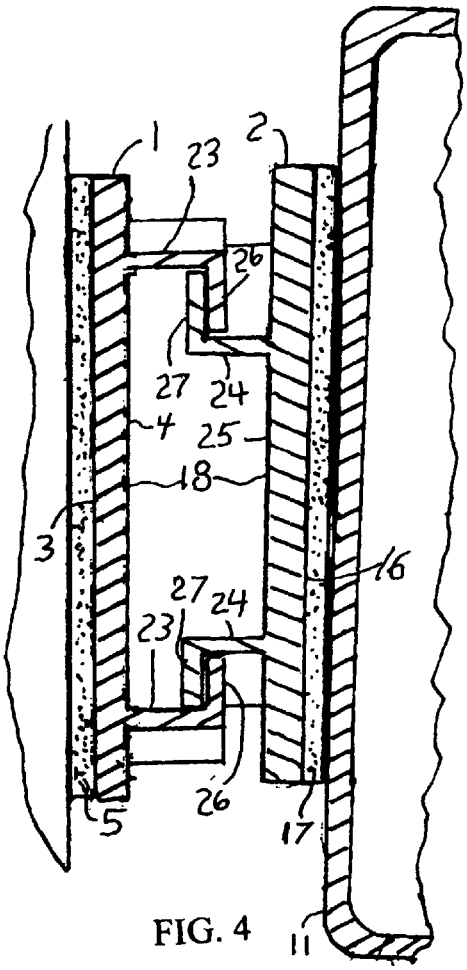
FIG. 4 is a sectional view through line 4-4 of FIG. 3 of the support in use.
Figure 5:
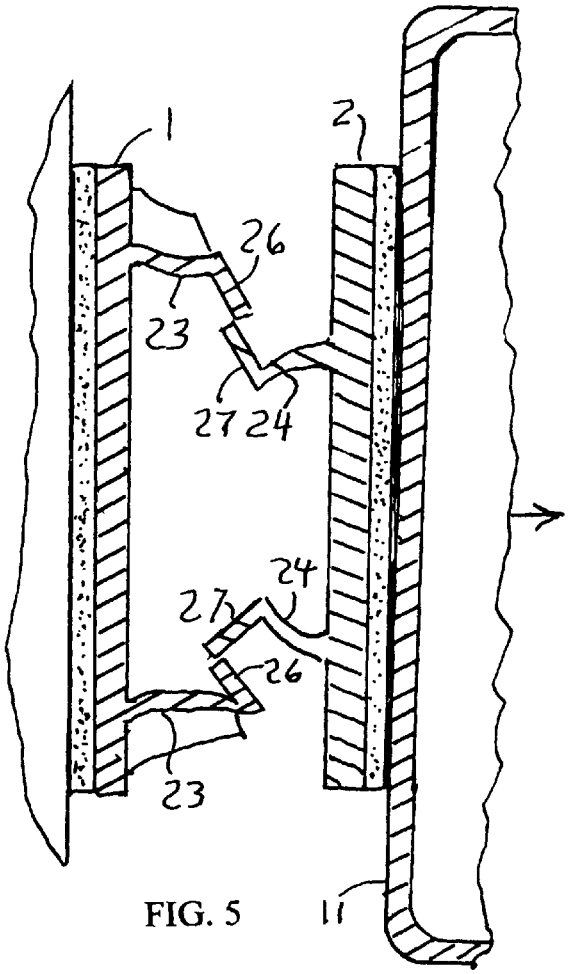
FIG. 5 is a section view as in FIG. 4, with the support being separated.

Referring now to the drawing FIGS. 3-5, another embodiment 15' of the apparatus is shown. The article support comprises two parts shown separated in FIG. 3, and joined together in use with an article 11 attached in FIGS. 4 and 5. The first part is a base member 1 having a first face 3, at least a portion of which is planar, to which is affixed a pressure sensitive adhesive 5. A release member (not shown) protects the adhesive until it is peeled off for use when it is applied to the vertical substrate 7. When the release member is removed, the base member is transparent. This feature enhances the appearance of the substrate when the article is removed. The second part of the support 15' is support member 2. Support member 2 comprises a body 18 with an article engaging face 16 having adhesive 17 for affixing to an article 11 such as a bottle, box, hook, and the like. The adhesive is protected before use by a release member (not shown). The bodies 18 of both part 1 and part 2 includes attaching means for releasably holding the support member 2 against the base member 1. These are flexible, wedge shaped elements that extend outwardly from each body from a face away from the adhesive side of the body. The flexible elements interact with each other to hold the support member to the base member. Extending from an opposed second face 4 of the base member 1 are a pair of flexible elements 23 that are close together at an upper end of the body and farther apart at a lower end of the body. Extending from an opposed second face 25 of the support member 2 are a pair of flexible elements 24 that are close together at an upper end of the body and farther apart at a lower end of the body. When base member 1 is affixed to the wall, the support member is attached by sliding the support member onto the base from above so that the flanges 26 of elements 23 fits onto the flanges 27 of elements 24. The support member and any article attached to it is removed from the base by lifting it up, or by pulling it straight out from the base. The elements 23 and 24 are flexible enough that they bend outwardly enough as shown in FIG. 5 to free the support member well before the force of pulling exceeds the peel strength of the adhesives.

Figure 7:
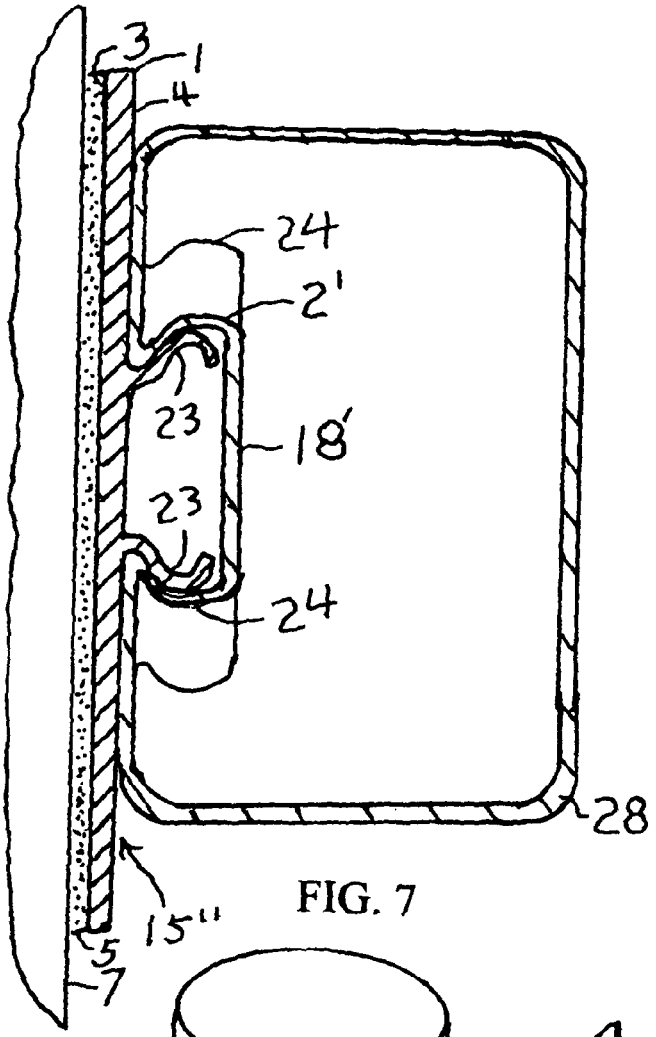
FIG. 7 is a sectional view through line 7-7 of FIG. 6.
Figure 8:
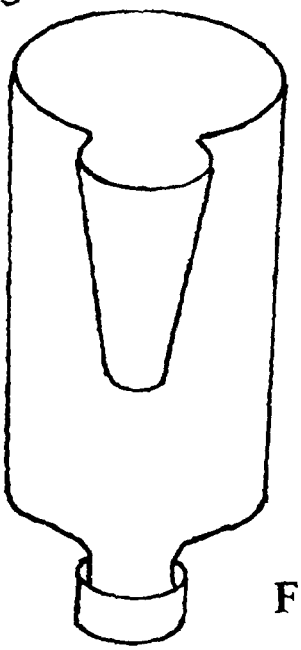
FIG. 8 is a perspective view of another embodiment of a support member of the invention.
Figure 6:
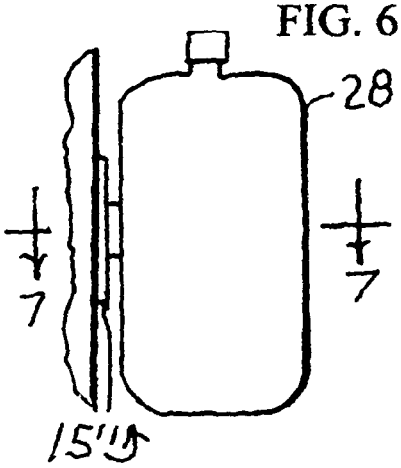
FIG. 6 is a side elevation view of another embodiment of the invention.

Referring now to the drawing FIGS. 6 and 7, another embodiment 15" of the apparatus is shown. The article support apparatus of the invention comprises two parts shown joined together in use in which the supported article is a blow molded container 28. The first part is a base member 1 having a first face 3, at least a portion of which is planar, to which is affixed a pressure sensitive adhesive 5. A release member (not shown) protects the adhesive until it is peeled off for use when it is applied to the vertical substrate 7. When the release member is removed, the base member is transparent. This feature enhances the appearance of the substrate when the article is removed. Extending from an opposed second face 4 of the base member 1 are a pair of flexible elements 23 that are close together at an upper end of the body and farther apart at a lower end of the body. The second part of the support 15" is support member 2' that is a portion of the blow molded container itself, so that there is no need for adhesive for attaching the support member to an article. Support member 2' includes a body portion 18' of the blow molded container. Extending from the body portion 18' are a pair of flexible elements 24 that are close together at an upper end of the body and farther apart at a lower end of the body. Flexible elements 23 of part 1 and 24 of part 2' provide attaching means for releasably holding the support member 2' against the base member 1. These are flexible elements that extend outwardly from each body. The flexible elements interact with each other to hold the support member to the base member. When base member 1 is affixed to the wall, the support member is attached by sliding the blow molded container onto the base from above so that the flanges 26' of elements 23 fits onto the flanges 27' of elements 24. The container is removed from the base by lifting it up, or by pulling it straight out from the base. At least one of the elements 23 and 24 is flexible enough that they bend outwardly enough to free the support member well before the force of pulling exceeds the peel strength of the adhesive. In this embodiment, the support member is recessed in the container wall. FIG. 8 shows an embodiment in which the support member extends outwardly from the container wall.

A transparent adhesive releasable by alcohol that has been found useful for this apparatus is 3M VHB Tape #4910 clear. Some surfaces may require a surface treatment for better adherence. 3M Tape Primer 94 has been found to be useful for this purpose. Other adhesives and primers may prove to be useful as well. When the body and adhesive of the apparatus are transparent, it is easier to ensure that the adhesive has made complete contact upon application.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. An article support adapted to be removably mounted on a planar vertical substrate, the article support comprising:

a transparent base member having a first face and an opposed second face;

a transparent pressure sensitive adhesive affixed to a planar portion of the first face for adhering to the planar vertical substrate, the adhesive being releasable with alcohol;

a release member on the adhesive adapted to protect the adhesive prior to use;

a support member adapted for supporting an article;

means for releasably holding the support member against the base member when the support member slidingly engages the base member from above, that disengages the support member from the base member when the support member is lifted up from the base member, and that flexes enough to release the support member from the base member when the support member and the base are pulled apart before the adhesive yields, the means for releasably holding the support member against the base member affixed in part to the second face of the base member and in part to the support member.

2. The article support of claim 1 in which the support member is a wall portion of a container.

3. The article support of claim 1 in which the support member is provided with adhesive for attaching to a container.

4. The article support of claim 1 in which the support member is a wall portion of a blow molded container.

* * * * *